US006726517B2

(12) United States Patent
Yamada et al.

(10) Patent No.: US 6,726,517 B2
(45) Date of Patent: Apr. 27, 2004

(54) COLD CATHODE FORMING PROCESS

(75) Inventors: Yuka Yamada, Kawasaki (JP); Takehito Yoshida, Kawasaki (JP); Nobuyasu Suzuki, Kawasaki (JP); Toshiharu Makino, Kawasaki (JP); Yoshikazu Hori, Kobe (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 139 days.

(21) Appl. No.: 09/988,396

(22) Filed: Nov. 19, 2001

(65) Prior Publication Data

US 2002/0061694 A1 May 23, 2002

(30) Foreign Application Priority Data

Nov. 20, 2000 (JP) ..... 2000-352324

(51) Int. Cl.[7] ..... H01J 9/00
(52) U.S. Cl. ..... 445/24
(58) Field of Search ..... 445/24, 25, 50, 445/51; 313/309, 336, 351

(56) References Cited

U.S. PATENT DOCUMENTS 5,646,474 A * 7/1997 Pryor ..... 313/310

FOREIGN PATENT DOCUMENTS

JP 61-064855 3/1986
JP 04-097216 3/1992

* cited by examiner

*Primary Examiner*—Kenneth J. Ramsey
*Assistant Examiner*—Joseph Williams
(74) *Attorney, Agent, or Firm*—Browdy and Neimark, P.L.L.C.

(57) ABSTRACT

The object of the present invention is to form the fine structure on a cathode surface homogeneously and reproducibly to realize the increased emission current value and stability with a simple process in the electron emission element forming process. An electron emission part of an electron emission element that is a crystalline thin film of electron emissive material formed in self-aligning fashion by means of a laser ablation process, in which a laser beam is irradiated onto a target material and the material ejected and emitted from the target material is deposited to form a thin film on a substrate facing to the target, is used as the thin film electron source. The above-mentioned structure is effective to realize the low electron emission threshold value and the increased emission current value and stability, and realize the reduced cost with the structure that is simpler than the conventional structure.

8 Claims, 6 Drawing Sheets

(a)

(b)

(c)

GAS PRESSURE: LOWER THAN 1 Torr

GAS PRESSURE: 1 TO 2 Torr

GAS PRESSURE: 5 Torr

COLD CATHODE FORMING PROCESS

BACKGROUND OF THE INVENTION

1. Field of the Invention

The present invention relates to an electron emission source that is expected to be applied to flat type solid display elements, and more particularly relates to a cold cathode type electron emission element that realizes the integration and low voltage operability and a process for forming the cold cathode type electron emission element.

2. Description of Prior Art

Heretofore, the hot cathode type electron emission element has been used popularly, however, electron emission by use of a hot electrode is disadvantageous because of large energy loss due to heating and because of requirement of pre-heating.

On the other hand, a small cold cathode structure has been realized with progress of vacuum micro-electronics technology, and the cold cathode type electron emission element has attracted attentions recently. Among the cold cathode type electron emission element, field effect type electron emission element, in which a high voltage is generated locally for field emission, has been developed actively.

FIG. 1 is a schematic partial cross sectional view showing an example of a conventional field effect type electron emission element. In FIG. 1, 11 denotes a substrate consisting of silicon (Si), 12 denotes an insulating layer consisting of $SiO_2$ formed on the substrate 11, 13 denotes a gate consisting of metal layer, and 14 denotes a circular cone electrode consisting of molybdenum (Mo).

In the case of the electron emission element having the structure as described hereinabove, when a voltage is applied between the substrate 11 and the gate 13, electrons are emitted from the cusp of the electrode 14 where a strong electric field is applied.

Furthermore, to realize a high performance electron source that is operable with a lower driving voltage than that of the conventional electron source, the reduction of the gate aperture and fabrication of a cathode having a steeper tip have been tried by applying LSI technology.

Though the conventional electron emission element is operable with a low voltage because it has a cone-shaped cathode having a small diameter and steeper tip as described hereinabove, this type of electron emission element is disadvantageous as described herein under.

At first, material having a low electron emission threshold value (electron affinity is small) is suitably used as electron emissive material, and metal W, metal Mo, nitride and oxide of these metals have been tried to be used. However, pure material that can be formed in the shape of cone configuration is limited as long as the conventional fabrication technique is employed.

Furthermore, electron emission stability and evenness are included in the most important performance to be considered when an electron source is to be used practically. In the conventional example, the emission current of a cathode is influenced strongly by the vacuum environment in operation and surface state of a top end of the cathode, and the physical property of the surface, for example, the work function of a current emission part, is changed during current emission to results in significant change of the operation current. As the result, the above-mentioned required performance is not satisfied. The reason is likely that emitted electrons collide with residual gas drifting near the cathode to generate ions, and the ions collide against the top end of the cathode to change the surface state of the top end of the cathode.

A process in which a cathode comprises a plurality of multi electron sources arranged at the time and the individual electron emission fluctuation is leveled to stabilize the emission current has been proposed to suppress the current fluctuation, however, the fluctuation has been still problematic in practical application because the fabrication process of cone-shaping is complex and the cone shape scatters significantly.

Furthermore, use of such field emission type electron source as CRT electron source has been tried, however, the fine electron beam, which is preferable for high vision system to obtain high definition, results in poor brightness. In other words, the tradeoff relation between brightness and definition is problematic.

SUMMARY OF THE INVENTION

The present invention has been accomplished in view of the above-mentioned problem, and the object of the present invention is to form fine structure on a cathode surface evenly and reproducibly with simple working process and to increase and stabilize the emission current value.

To solve the above-mentioned problem, in a cold cathode forming process of the present invention, a target material and a substrate are provided in a reaction chamber, the pressure (P) of an ambient gas introduced into the reaction chamber and the distance (D) between the substrate and the target material are controlled so that the size of a high temperature high pressure area formed near the target material by irradiating a beam light onto the target material is optimal, and the material contained in the target material is excited and ejected by irradiating the beam light onto the target material with introducing the ambient gas into the reaction chamber at the pressure to deposit the material on the substrate. The above-mentioned structure is effective not only for simplification of the manufacturing process and cost reduction but also for obtaining self align type crystalline structure.

An electron emission part of an electron emission element of the present invention comprises a cold cathode having a crystalline thin film of electron emissive material formed by means of the above-mentioned cold cathode forming process. The above-mentioned structure is effective for realizing the reduced electron emission threshold value and the increased emission current value and stability, and realizing the reduced cost with the structure simpler than the conventional structure.

Furthermore, the present invention provides a cold cathode forming process characteristically comprising a step for providing a target material and a substrate in a reaction chamber, a step for controlling the pressure (P) of an ambient gas introduced into the reaction chamber and the distance (D) between the substrate and the target material so that the size of a high temperature high pressure area formed near the target material by irradiating a beam light onto the target material is optimal, and a step for exciting and ejecting the material contained in the target material by irradiating the beam light onto the target material with introducing the ambient gas into the reaction chamber at the pressure to deposit the material on the substrate.

The present invention provides a process in which the pressure (P) of the ambient gas and the distance (D) between the substrate and the target material is controlled according to the relation $PD^n$=constant (n is approximately 2 to 3).

According to this process, the interaction (collision, scattering, enclosing effect) between material emitted from the target upon laser irradiation (mainly atoms, ions, and clusters) and the inert gas is optimized to bring about a thin film having the self-align type crystalline structure with maintaining the stoichiometric composition.

Furthermore, the present invention provides a process in which an inert gas is used as the ambient gas. According to this process, a cold cathode is formed without introduction of oxidative gas.

Furthermore, the present invention provides a process in which the pressure of the ambient gas is in the range from 0.1 to 10 Torr. According to this process, a thin film having the same composition as that of the target material is formed suitably.

Furthermore, the present invention provides a process in which the material that constitutes the target consists of at least two or more composition.

Herein, the material that constitutes the target material is preferably any one compound of $LaB_6$, TiC, SiC, and SnC. Otherwise, the material may be any typical nitride of TiN, BN, SrN, ZrN, and HfN, or may be any one transparent conducting material selected from a group including $In_2O_3$, $SnO_2$, ITO, ZnO, $TiO_2$, $WO_3$, and $CuAlO_2$.

Furthermore, the present invention characteristically provides an electron emission element having an electron emission part comprising a cold cathode consisting of crystalline thin film of electron emissive material formed by means of the cold cathode forming process. The above-mentioned structure is effective for realizing the reduced electron emission threshold value and the increased emission current value and stability, and for realizing the low cost with the structure simpler than the conventional structure.

Furthermore, the present invention characteristically provides an electron emission element having an electron emission part comprising a cold cathode consisting of crystalline thin film of electron emissive material formed by means of the cold cathode forming process formed on the substrate with interposition of a conductive film or resistive film. The above-mentioned structure is effective for realizing the reduced electron emission threshold value and the increased emission current value and stability, and for realizing the low cost with the structure simpler than the conventional structure.

Herein, the material that constitutes the target material is preferably any one compound of $LaB_6$, TiC, SiC, and SnC. Otherwise, the material may be any typical nitride of TiN, BN, SrN, ZrN, and HfN.

Furthermore, the present invention characteristically provides a CRT provided with an electron emission element as the electron source. The above-mentioned structure is effective for realizing a high brightness and fine high vision CRT.

Furthermore, the present invention characteristically provides a flat display provided with an electron emission element as the electron source. The above-mentioned structure is effective to realize a low cost flat display.

Furthermore, the present invention provides an electron emission type element provided with a transparent substrate and a cold cathode comprising a crystalline thin film of electron emissive material formed on the transparent substrate.

Furthermore, the present invention provides a electron emission type element provided with a transparent substrate and a crystalline thin film of electron emissive material formed on the transparent substrate by means of the cold cathode process formed on the substrate with interposition of an interference layer consisting of conductive film or resistive film.

Herein, the crystalline thin film that constitutes the cold cathode is preferably formed of a transparent conducting material selected from a group including $In_2O_3$, $SnO_2$, ITO, ZnO, $TiO_2$, $WO_3$, and $CuAlO_2$.

Furthermore, the present invention characteristically provides a transmission type flat display provided with an electron emission element as the electron source. The above-mentioned structure brings about realization of a high brightness and fine transmission type flat display.

As described hereinabove, in a cold cathode forming process of the present invention, a target material and a substrate are provided in a reaction chamber, the pressure (P) of an ambient gas introduced into the reaction chamber and the distance (D) between the substrate and the target material are controlled so that the size of a high temperature high pressure area formed near the target material by irradiating a beam light onto the target material is optimal, and the material contained in the target material is excited and ejected by irradiating the beam light onto the target material with introducing the ambient gas into the reaction chamber at the pressure to deposit the material on the substrate. The above-mentioned structure is effective to obtain the self-align type crystalline structure easily in comparison with the conventional forming process.

According to the present invention, the electron emission part is used as the thin film electron source provided with a cold cathode having a crystalline thin film of electron emissive material formed by means of the above-mentioned cold cathode forming process. Thereby, the above-mentioned structure is effective to realize the reduced cost with the structure simpler than the conventional structure. The electron emission element having the above-mentioned structure is fabricated reproducibly, and the dispersion between elements is less, and the increased current density is realized as the multi source. Therefore, the electron emission element can be used as a high brightness and fine CRT electron source. Furthermore, a transparent substrate is used as the substrate and transparent conducting material is used as the material of the crystalline orientation film to realize a transparent flat display.

The object and advantage of the present invention will be more apparent by examples described hereinafter with reference to the drawings.

DETAILED DESCRIPTION OF THE PREFERRED EMBODIMENTS

An electron emission element and a process for fabrication of the electron emission element will be described hereinafter in detail with reference to FIG. 2 to FIG. 6.

Figure 1:
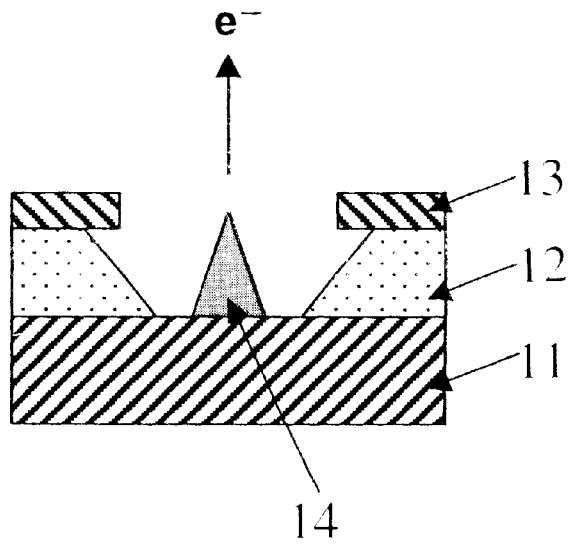
Fig. 1 (Prior Art)
FIG. 1 is a schematic partial cross sectional view showing one example of a conventional field effect type electron emission element.
Figure 2:
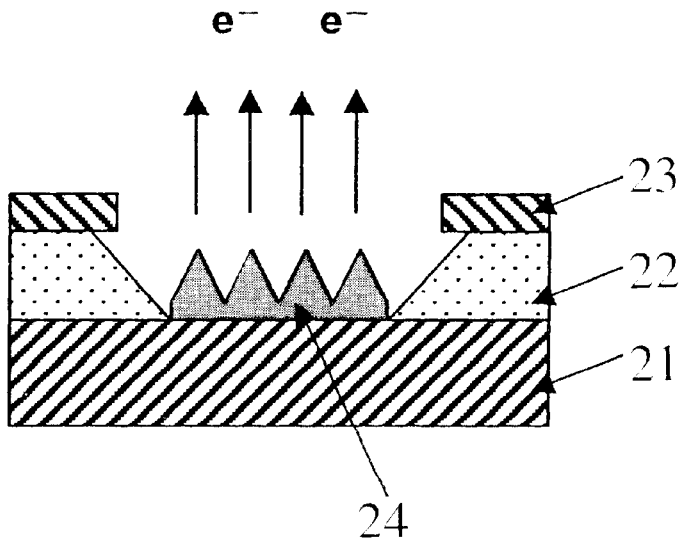
FIG. 2 is a cross sectional view showing the structure of an electron emission element in accordance with an embodiment 1 of the present invention.

FIG. 2 is a cross sectional view showing the structure of an electron emission element of the present invention. In FIG. 2, 21 denotes a substrate consisting of Si, 22 denotes an insulating layer consisting of oxide film such as $SiO_2$ or $Al_2O_3$ formed on the substrate 21, 23 denotes a gate consisting of metal such as Mo, and 24 denotes a crystalline thin film formed on the open area of the substrate 21. The crystalline thin film 24 emits electrons easily when a voltage is applied between the substrate 21 and the gate 23 because the crystalline thin film 24 consists of electron emissive material. Because electrons are emitted from the fine structure parts directed in the same direction, a cold cathode of multi sources that emit electrons in the same direction is obtained. As the result, the current density is increased and stabilized, and the electron emission element can be used, for example, as a high-vision electron source, for which high brightness and high definition are required.

Next, a process for forming a crystalline thin film that is served as a cold cathode of the field emission element shown in FIG. 2 will be described. In the present embodiment, a transparent conducting oxide thin film is deposited on the substrate by use of laser ablation in an inert background gas (Ar, He). Herein, the laser ablation process means a process in which a high energy density laser beam (pulse energy: 1.0 $j/cm^2$ or higher) is irradiated onto a target material and the surface of the irradiated target material is melted and ejected.

This process is characterized in non-thermal equilibrium and non-mass process. A detailed effect of the non-thermal equilibrium process is characterized in that spatial and time selective excitation can be applied. In particular, because of the spatial selection excitation of this process, only required material source can be excited to bring about clean process for suppressing contamination of impurity differently from the conventional thermal process and plasma process in which a wide area or the whole area of a reaction vessel is exposed to heat and ions. Furthermore, the non-mass means the process that can be carried out with significantly reduced damage in comparison with the non-thermal equilibrium ion process. The ejected material in the laser ablation mainly includes atoms, molecules, and clusters (formed of several to several tens of atoms), which are mainly ions and neutral particles), and the kinetic energy is as high as several tens eV for ions and several eV level for the neutral particles. This energy level is significantly higher than that of heat evaporation atoms, but significantly lower than that of ion beam.

The laser ablation process that is clean and results in less damage is suitable for fabrication of a thin film of less contamination and controlled composition and crystallinity. Furthermore, a thin film is formed in various gases and in a wide range gas pressure due to the transmissivity of the laser light by means of the laser ablation process. Furthermore, because these advantages are not dependent on the melting point and vapor pressure, the laser ablation process is used to process materials having the different melting point and vapor pressure simultaneously (evaporation and depositing) to form a film consisting of multicomponent material differently from the conventional thermal equilibrium process technique that cannot be used for such multicomponent material deposition.

It is desirable that a target material absorbs the laser light that is the light source in the wavelength region of the laser light to form a thin film by use of the laser ablation process. In general, because the band gap energy of transparent conducting oxide material is 3 eV or higher, it is desirable to use an excimer laser or a YAG laser with harmonic wave as the light source.

FIG. 3A and FIG. 3B are diagrams showing a thin film forming equipment used for the cold cathode forming process of the present invention. Herein, the case in which laser ablation is carried out by use of a transparent conducting oxide target to form a homogeneous transparent conducting oxide thin film will be described.

In FIG. 3A, 101 denotes a metal reaction chamber in which a target is placed. An ultra vacuum exhauster that is used to evacuate the internal of the reaction chamber 101 up to ultra vacuum by exhausting air in the reaction chamber 101 is provided on the bottom of the reaction chamber 101. In the reaction chamber 101, a gas introduction line 104 is provided to supply the ambient gas into the reaction chamber 101. A mass flow controller 103 is attached to the gas introduction line 104 to control the flow rate of the ambient gas supplied to the reaction chamber 101. Furthermore, a gas evacuation system 105 is provided on the bottom of the reaction chamber 101 to exhaust the ambient gas in the reaction chamber 101.

A target holder 106 is provided in the reaction chamber to hold a target 107. A rotation shaft is attached to the target holder 106 to rotate the target 107 by rotating the rotation shaft under the control performed by a rotation controller not shown in the drawing. A deposition substrate 109 is provided so as to face to the surface of the target 107. Material that is ejected and emitted from the target 107 excited by means of irradiation of the laser beam is deposited on the deposition substrate 109. Herein, $In_2O_3$ polycrystalline sintered target is used as the target.

A pulse laser light source 108 used for irradiating a laser beam that functions as an energy beam on the target 107 is provided outside the reaction chamber 101. A laser window 110 that is used to introduce the laser beam into the reaction chamber 101 is provided on the top of the reaction chamber 101. A slit 111, a lens 112, and a reflection mirror 113 are disposed in the order from the position near to the laser beam source on the optical path of the laser beam that comes out from the pulse laser beam source 108, and the laser beam that comes out from the pulse laser beam source 108 is shaped by means of the slit 111, converged by means of the lens 112, reflected by means of the reflection mirror 113, and irradiated onto the target 107 disposed in the reaction chamber 101 through the laser beam introducing window 110.

The operation of the thin film forming equipment having the above-mentioned structure will be described herein under. The internal of the reaction chamber 101 is exhausted up to the attainable vacuum $1.0\times10^{-9}$ Torr by means of the ultra vacuum evacuation system 102 having mainly a turbo molecular pump, and He gas is introduced from the gas introduction line 104 through the mass flow controller 103. The rare gas pressure in the reaction chamber 101 is set to one pressure value in the range from 0.1 to 10 Torr by cooperation with the gas evacuation system 105 having mainly a dry rotary pump or high pressure turbo molecular pump.

In this state, a laser beam is irradiated from the pulse laser beam source 108 onto the surface of 4N purity $In_2O_3$ polycrystalline sintered target 107 disposed on the target holder 106 having an auto rotation mechanism. Herein, the argon-fluoride (ArF) excimer laser (wavelength: 193 nm, pulse width: 12 ns, energy density: 1 J/cm$^2$, and repetition rate (frequency): 10 Hz) is used. At that time, the laser ablation phenomenon occurs on the surface of the $In_2O_3$ target 107, irons such as In, O, InO, and $In_2O_3$ or neutral particles (atoms, molecules, and clusters) having the initial kinetic energy of 50 eV for ion and 5 eV for neutral particle are ejected and come out maintaining the size of the molecule and cluster level mainly in the normal line direction of the target. The ejected material collides with atmospheric rare gas atoms and scatters and flies into various direction, the kinetic energy is dissipated in the atmosphere, and deposits on the deposition substrate 109 that is facing to the target 107 with interposition of a space of about 3 cm to form a homogeneous thin film. The temperature of the substrate and the target is not controlled actively.

He gas is used as the ambient gas herein, but other inert gases such as Ar, Kr, Xe, and N may be used instead. In such case, the pressure may be set so that the gas density is equal to the gas density of He gas. For example, in the case that Ar (gas density: 1.78 g/l) is used as the ambient gas, the pressure may be set to 1/10 on the base that He (gas density: 0.18 g/l) is considered as the reference.

Otherwise, a mixed gas containing a rare gas (Ar, He) and an oxidative gas ($O_2$, $O_3$, $n_2O$, $NO_2$) may be used. In this case, an oxidative gas may be mixed with a rare gas so that the percentage of an oxidative gas is 50% or less by volume, and pressure may be set so that the average gas density of the ambient gas is equal to the gas density of He dilution gas.

The indium oxide thin film formed on the deposition substrate with changing He gas pressure, that is the background gas, by means of the above-mentioned process is characterized by X-ray diffraction measurement and electron microscope observation to check the crystallinity.

The electron microscope observation photograph of each deposition thin film is shown in FIG. 4A to FIG. 4C. FIG. 4A, FIG. 4B, and FIG. 4C are thin films that are deposited at He gas pressure of 0.5 Torr, 2.0 Torr, and 5.0 Torr respectively. FIG. 4A shows fine particle deposition, but FIG. 4B shows self-aligned type crystalline structure having projections. On the other hand, FIG. 4C shows micro-crystal aggregate structure.

Figure 5:
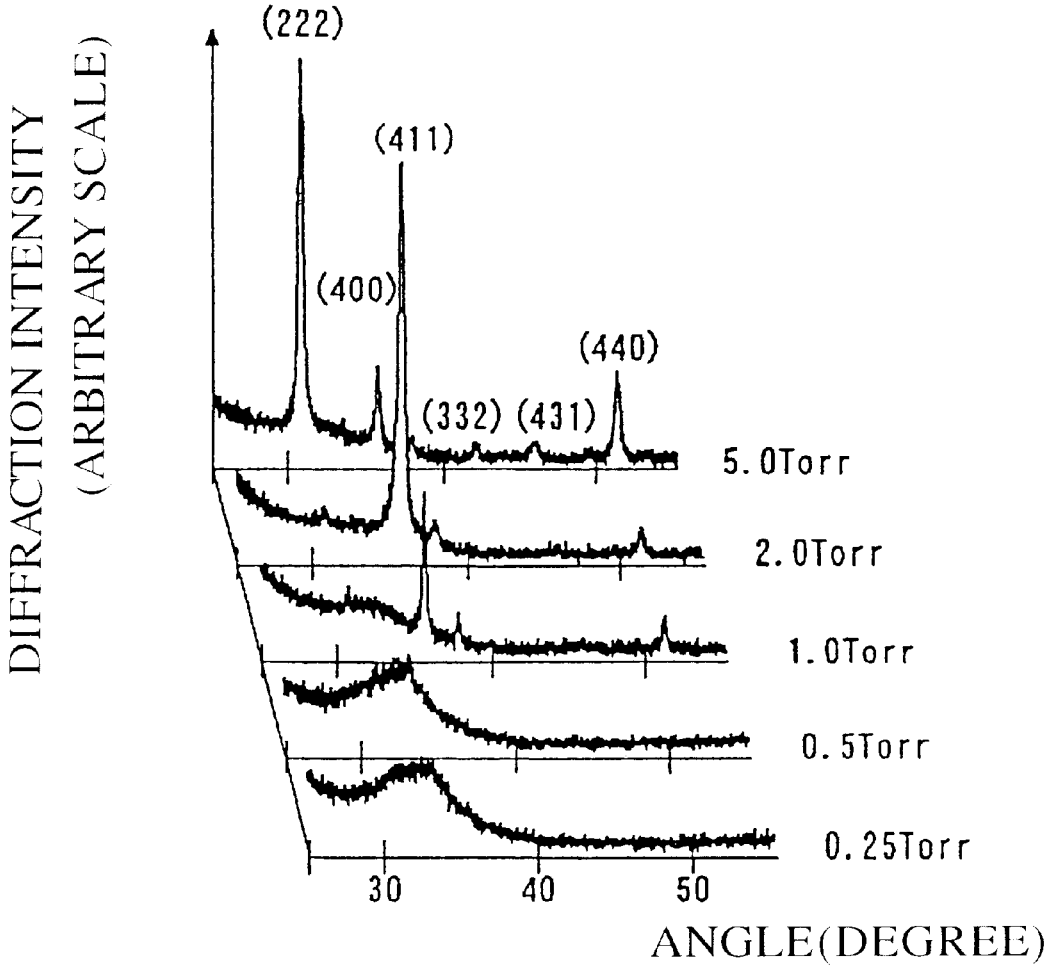
FIG. 5 is a diagram showing an X-ray diffraction measurement result of a thin film obtained by means of a process in accordance with the embodiment 1 of the present invention.

FIG. 5 shows X-ray diffraction measurement result of these deposit thin films. A broad peak is found around the diffraction angle of 33 degrees for the samples that have been formed under He gas pressure of 0.5 Torr or lower. The peak position corresponds to (101) plane of In crystal, but the peak likely shows amorphous structure or fine particle aggregate structure because the full width at half maximum is wide. On the other hand, four diffraction peaks corresponding to $In_2O_3$ crystalline structure for the samples formed under He gas pressure of 1.0 Torr and 2.0 Torr are found, and (400) orientation is remarkable particularly. The sample formed under He gas pressure of 5.0 Torr has seven diffraction peaks, it is found that this sample has no orientation structure because the intensity ratio between respective peaks of this sample is the same as that of the powder standard sample.

The above-mentioned result shows that an oxide thin film having no oxygen deficiency can be formed by controlling the ambient gas pressure in the oxide thin film depositing process employed in the thin film forming process of the present embodiment even if an inert gas containing no oxygen is used. In other words, the result shows that it is possible to form crystal orientation oxide thin film having the stoichiometric composition by optimizing the interaction between material emitted from the target when the laser is irradiated thereon (mainly atoms, ions, and clusters) and inert gas.

Furthermore, the effect of the ambient gas in the laser ablation is examined herein under. The material emitted from the target surface when the laser beam is irradiated on the target is not evaporated with maintaining the target composition, and propagates mainly in the form of atoms and ions with maintaining direct advance. However, if there is the ambient gas, the material is scattered or looses the energy, and the ambient gas causes the change of spatial distribution, depositing speed, and distribution of kinetic energy of deposit material in the process of thin film forming. The change is different depending on the type of emitted material and kinetic energy. However, in general, heavy material (herein referred to as In) is less scattered and likely maintains direct advance in the laser ablation in the gas atmosphere. As the result, in the case that a thin film is formed under a low gas pressure, the emitted material reaches to the substrate with deficiency of oxygen that is susceptible to scattering and has a high vapor pressure.

Atoms and ions emitted from the target proceed with different speed initially, but under the high ambient gas pressure condition the atoms and ions are subjected to collision and scattering due to the ambient gas, and the speed becomes uniform and slow. As the result, the emitted material is enclosed in the broom 114 as shown in FIG. 3B, the oxygen leak due to a low gas pressure is suppressed. In the laser ablation in the rare gas atmosphere, this effect is significantly important because oxygen in the deposit thin film is only supplied from oxygen emitted from the target.

However, the rapid change of the crystalline structure of the thin film deposited in He gas atmosphere cannot be attributed only to the increased oxygen supply due to spatial oxygen enclosure.

When the laser ablation is carried out in a high pressure gas atmosphere, the ambient gas is compressed to increase the pressure and temperature, and a shock front is formed. Herein, the effect of the shock front in oxide forming is examined herein under. The increased pressure promotes $In_2O_3$ forming, which brings about reduction of volume and number of moles. The increased temperature promotes thermally excitation of the emitted material. However, because the increased temperature functions to increase the free energy of $In_2O_3$ formation, formation of $In_2O_3$ is inhibited. As the shock front proceeds and the distance from the target increases, the pressure and temperature are decreased slowly. Furthermore, the energy of formation becomes low concomitantly with temperature decrement. As the result of the above, the area where the high pressure condition and the high temperature condition that satisfies sufficiently low energy of formation are both realized is formed at the place distant from the target with a certain distance, and oxidation reaction is promoted in this area. In other words, $In_2O_3$ that maintains stoichiometric composition is formed in the facilitated oxidation region in the gas phase, and the transparent thin film is obtained on the substrate.

Furthermore, a thin film formed on a glass substrate at a room temperature by means of the conventional process has the amorphous structure. On the other hand, a thin film formed on a synthetic quartz substrate at a room temperature by means of the process of the present embodiment has the $In_2O_3$ thin film crystalline structure. Furthermore, as for orientation, He gas pressure of 1.0 to 2.0 Torr gives strongly orientated structure, but 5.0 Torr gives non-oriented structure. This result is likely attributed to the reason described here in under based on the positional relation between the facilitated oxidation region formed by means of the shock front and the deposition substrate (refer to FIG. 6).

In detail, after nuclei of the $In_2O_3$ is formed as the result of promotion of oxidation reaction in the facilitated oxidation region in the gas phase, the nuclei is cooled rapidly concomitantly with flying and grows to the microcrystal. If the deposition substrate is disposed so as to contact with the facilitated oxidation region, the substrate surface is rendered active, and the nuclei formed in the gas phase is oriented and grows to a crystal concomitantly with migration of the nuclei. On the other hand, if the deposition substrate is disposed outside the facilitated oxidation region, a microcrystal that grows in the gas phase reaches to and coagulates on the substrate to result in the structure of no orientation. Under the process condition employed in the present embodiment, in the case of He gas pressure of 1.0 to 2.0 Torr, the deposition substrate is likely disposed so as to contact with the oxygen promotion area formed by means of shock front.

As described hereinabove, the correlation between the ambient gas pressure (P) and the distance between the target and substrate (D) should be maintained for laser ablation. The material emitted from the target by laser irradiation forms the plasma state that is so-called as plume. The size of a plume depends on the gas pressure because the plume is influenced by collision with the ambient gas, and the larger gas pressure gives the smaller plume.

On the other hand, to obtain the oriented thin film of the stoichiometric composition, it is desirable that the above-mentioned facilitated oxidation region formed in the plume is in contact with the substrate. In detail, D=3 cm in the present embodiment. In this case, the oriented thin film is obtained under the condition of P=1.0 Torr. In the case that D is to be larger, the plume is made larger. In other words, the gas pressure may be lowered. Furthermore, the film quality of a deposit thin film depends significantly on the speed of the material emitted from the target at the time when the material reaches to the deposition substrate. Therefore, to obtain the same film quality, the correlation $PD^n$=constant should be maintained as the process condition to obtain a constant speed, and n value is preferably in the range of 2 to 3. Therefore, for example, in the case that D is double, the corresponding gas pressure may be ¼ to ⅛.

As described hereinabove, in the cold cathode forming process of the present embodiment, to prevent composition deviation from the stoichiometric composition due to the removal of the high vapor pressure element in the case that the laser ablation is carried out by use of a target material consisting of the material containing the high vapor pressure element (herein, oxygen), the ambient gas pressure and the distance between the target and the deposition substrate are controlled so that the crystalline thin film of the stoichiometric composition is formed by forming a plume having a suitable size, instead of the process in which the high vapor pressure element is supplemented to the ambient gas by use of a gas that contains the high vapor pressure element. In other words, the loss of the high vapor pressure element is prevented in the plume having a suitable size, and a thin film of approximately the same composition as that of the target is formed on the deposition substrate. The plume having a suitable size means the size of the plume that allows the facilitated oxidation region formed in the plume to be in contact with the surface of the deposition substrate. Therefore, in the cold cathode forming process in accordance with the present embodiment, the ambient gas pressure that is sufficient to form a plume having such suitable size and the distance between the target and the deposition substrate are set properly.

In the use of this process, the pressure of the ambient gas is controlled, that is, the collision frequency between material ejected from the target and the ambient gas atoms is controlled to control the proportion of the high vapor pressure element enclosed in the high temperature high pressure area formed in the plume. Thereby, it is made possible to control the configuration of the crystal and defect of the thin film to be formed.

Furthermore, in some cases, a thin film is involved in the problem of poor crystallinity and defect immediately after forming. When such problem is found, oxidation of the thin film in an oxygen atmosphere or heat treatment in a nitrogen atmosphere is effective to improve the film quality such as crystallinity and purity.

As described hereinbefore, the crystalline orientation oxide thin film having the stoichiometric composition can be formed by applying the cold cathode forming process of the present embodiment without introduction of $O_2$ gas and substrate heating. Therefore, by using this process, the fabrication process is simplified and low cost process is realized without limitation of substrate material used to form the cold cathode.

Furthermore, in the case of the cold cathode formed by means of the above-mentioned process, a voltage of approximately 10 V/$\mu$m is applied between the Mo metal layer 23 and crystalline thin film 24 at a degree of vacuum of $10^{-6}$ Torr and a target to be irradiated is placed at the position 3 mm apart vertically, the stable electron emission of approximately 1 mA/cm$^2$ is confirmed. Based on the result, it is found that the formed cold cathode forms a plurality of self-aligned projections as shown in FIG. 4B and a voltage is applied to the projections, a high electric field intensity is applied on the respective projections to result in the reduced electron emission threshold value, and the increased and stabilized emission current value is realized as a whole.

The cold cathode forming process applied by use of $In_2O_3$ thin film, which is binary based transparent conducting oxide thin film, is described hereinabove, however, it is possible to use any one transparent conducting material of $SnO_2$, ITO, ZnO, $TiO_2$, $WO_3$, and $CuAlO_2$ as the cold cathode material.

The process in accordance with the present embodiment can be applied not only to transparent conducting material but also to material having a low electron emission threshold value (small electron affinity) that is suitably used as the cold cathode material. Particularly, this process can be applied to form a thin film consisting of multicomponent material by processing materials that are different in the melting point and vapor pressure simultaneously (evaporation and deposit). Forming of such thin film has been difficult by means of the conventional thermal equilibrium process technique. Examples of such materials include compounds such as $LaB_6$, TiC, SiC and SnC and typical nitrides such as TiN, BN, SrN, ZrN and HfN. Furthermore, in the case that metal material (W, Mo), which is oxidized easily and difficult to form projection configuration by means of the conventional process, is used as the electron emission material, it is possible to form high purity projection configuration with self-alignment by use of a high purity target.

As described hereinbefore, because electrons are emitted from micro-structure parts directed in the same direction in the case of the electron emission element of the present embodiment, the present invention provides a multi source cold cathode that emits electrons in the same direction. Therefore, in the case that the cold cathode is applied to a CRT electron source, the structure of an electron gun that is used for accelerating and converging electrons is simplified differently from the case in which a conventional electron source is used, and a thin CRT can be realized. Furthermore, the current density of the electron source is increased and stabilized, the electron source of this type can be used as a high vision electron source for which high brightness and high definition are required.

(Second Embodiment)

Figure 7:
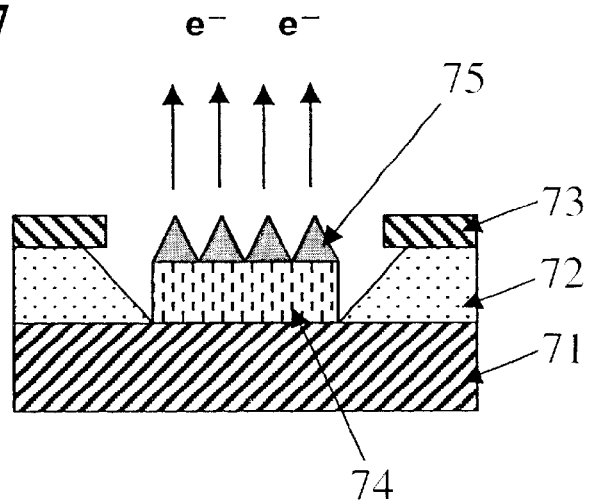
FIG. 7 is a cross sectional view showing the structure of an electron emission element in accordance with an embodiment 2 of the present invention.

Another electron emission element and fabrication process for fabricating the electron emission element will be described in detail hereinafter with reference to FIG. 7. FIG. 7 is a cross sectional view showing the structure of an electron emission element of the present invention. In FIG. 7, 71 denotes a substrate consisting of Si, 72 denotes an insulating layer formed of oxide film consisting of materials such as $SiO_2$ and $Al2O_3$ formed on the substrate 71, 73 denotes a gate formed of metal layer consisting of Mo, 74 denotes a conductive film or an interference layer formed on the open area of the substrate 71, and 75 is a crystalline thin film formed on the interference layer 74.

In the structure described hereinabove, the crystalline thin film 75 consists of electron emissive material, and a voltage is applied between the substrate 71 and the gate 73 to emit electrons easily. Because electrons are emitted from the fine structure parts directed in the same direction, and a multi source cold cathode that emits electrons in the same direction is obtained. Herein, the film thickness of the crystalline thin film 75 and the interference layer 74 is controlled so that the electron emission end is disposed on the same plane position of the gate when the crystalline thin film 75 is formed with interposition of the interference layer 74 to increase the electric field intensity, that is, the electron emission starting voltage is reduced. Furthermore, the interference layer is formed of a resistive film to stabilize the current. Furthermore, the interference layer that is a under layer for forming the crystalline thin film is formed of a conductive film or resistive film having the same orientation as that of the crystalline thin film to promote crystallization of the thin film formed thereon, and the top end configuration of the electron emission part is stabilized.

As the result of the above, the current density is increased and stabilized, for example, the above-mentioned electron emission element can be used as a high vision electron source for which the high brightness and definition are required.

Next, the forming process for forming a crystalline thin film that is used for a cold cathode of the electric field emission element shown in FIG. 7 will be described. In the present embodiment, after the interference layer is formed on the substrate, a metal nitride thin film consisting of electron emissive material is deposited by means of laser ablation in a rare gas (Ar, He) atmosphere.

Herein, a process for forming a homogeneous metal nitride thin film by use of the thin film forming equipment described in the embodiment land shown in FIG. 3 by means of laser ablation, in which a metal nitride target is used, will be described.

Figure 3:
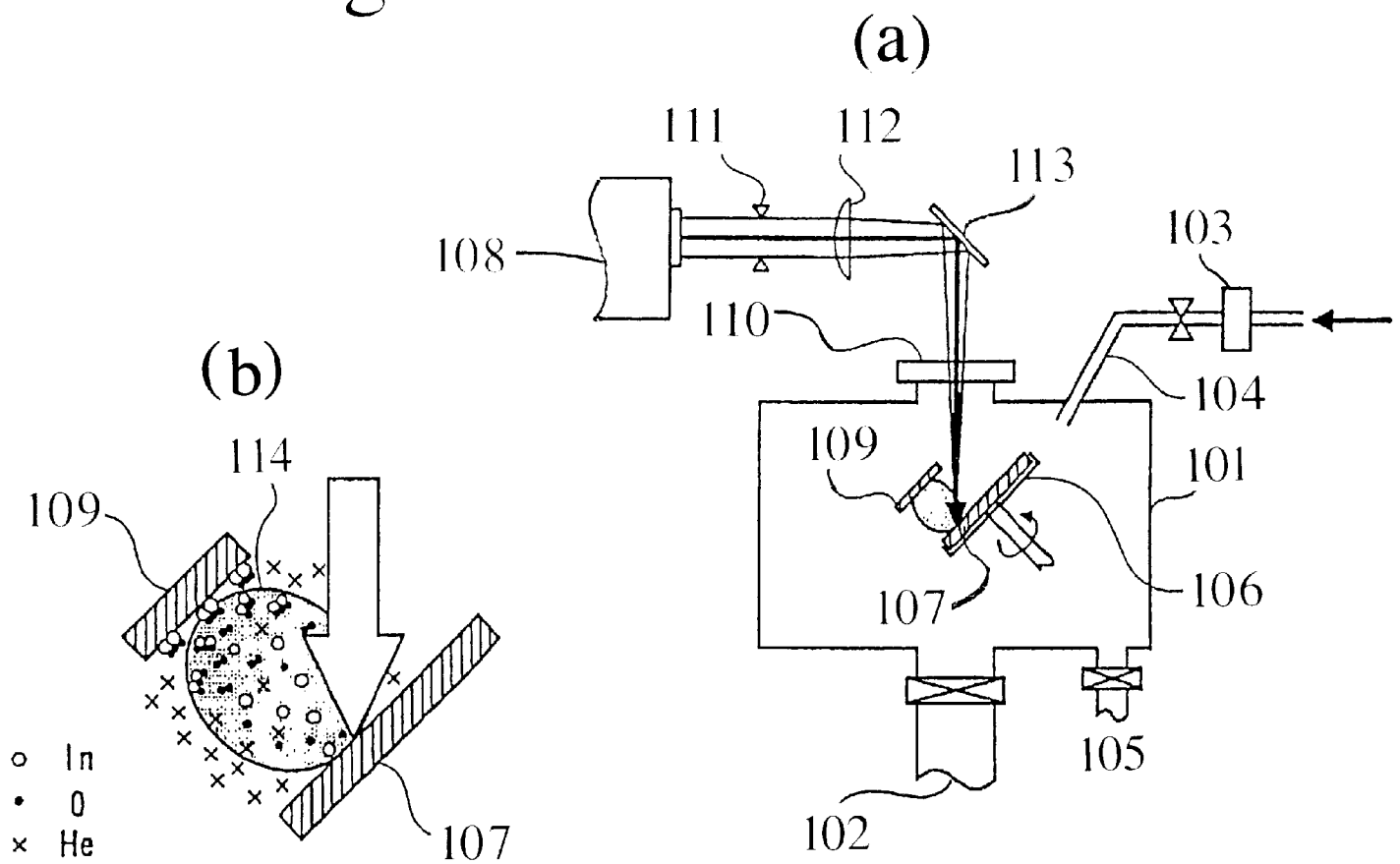
FIG. 3A is a structural diagram showing a thin film forming equipment used in the process of the present invention.
FIG. 3B is a diagram for describing a phenomenon that occurs between a deposition substrate and a target.
Figure 4:
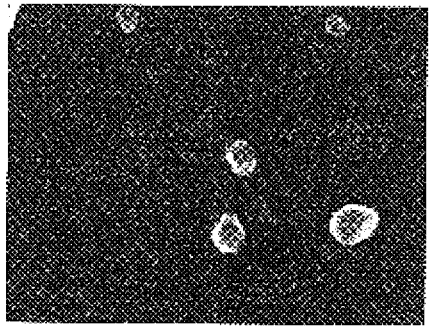
FIG. 4A to FIG. 4C are electron microscope photographs of a thin film obtained by means of a process in accordance with the embodiment 1 of the present invention.
Figure 4:
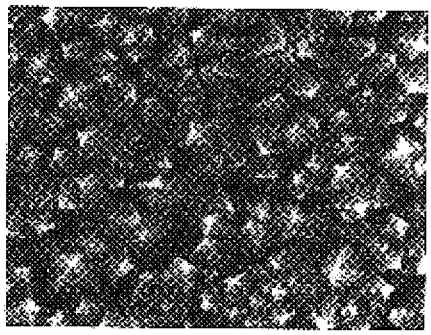
Figure 4:
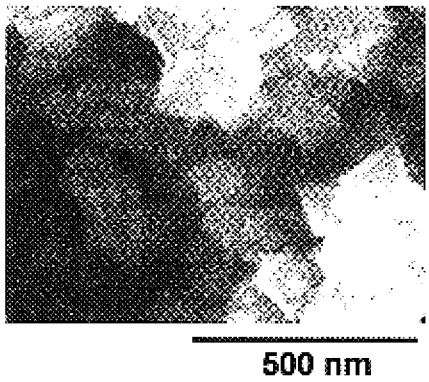

In the thin film forming equipment shown in FIG. 3, at first the internal of the reaction chamber 101 is exhausted up to about attained vacuum of $1.0\times10^{-9}$ Torr by means of a ultra high vacuum evacuation system 102 mainly comprising a turbo molecular pump, and He gas is then introduced from the gas introduction line 104 through the mass flow controller 103. At that time, by interlocking with the operation of the gas evacuation system 105 mainly comprising a dry rotary pump or high pressure turbo molecular pump, the rare gas pressure in the reaction chamber 101 is set to a pressure value in the range from about 0.1 to 10 Torr. With keeping this state, a laser beam is irradiated from the pulse laser beam source 108 onto the surface of a 4N purity polycrystalline sintered target 107 disposed on the target holder 106 having an autorotation mechanism. Herein, argon-fluoride (ArF) excimer laser (wavelength: 193 nm, pulse width: 12 ns, energy density: 1 $J/cm^2$, and repetition rate (frequency): 10 Hz) is used. At that time, the laser ablation phenomenon occurs on the surface of the TiN target 107, ions or neutral particles (atoms, molecules, and clusters) of Ti, N, or TiN depart from the target 107 having the initial kinetic energy of 50 eV for ions and 4 eV order for the neutral particles, and are emitted mainly in the normal line direction of the target with maintaining the size of molecule and cluster level. Thereafter, the departed material collides against the atmospheric rare gas atoms and the direction of flight is scattered and the kinetic energy is dissipated into the atmosphere, and the material deposits on the facing deposition substrate 109 disposed about 3 cm apart to form a homogeneous thin film. The temperature of the substrate and the target is not controlled actively.

He gas is used as the ambient gas in the above-mentioned embodiment, but an inert gas such as Ar, Kr, or Xe may be used. In this case, the pressure may be set so that the gas density is equal to that in the case of He gas. For example, in the case that Ar (gas density of 1.78 g/l) is used as the ambient gas, the pressure may be set to about 1/10 of the reference He pressure (gas density of 0.18 g/l).

Otherwise, a mixed gas containing rare gas (Ar, He) and nitrogenous gas ($n_2$, $NH_3$) may be used. In this case, a nitrogenous gas may be mixed with a rare gas so that the percentage of a nitrogenous gas is 50% or less by volume, and pressure may be set so that the average gas density of the ambient gas is equal to the gas density of He dilution gas.

The titanium nitride thin film formed on the deposition substrate with changing He gas pressure, that is the ambient gas, by means of the above-mentioned process is subjected to X-ray diffraction measurement and electron microscope observation to check the crystalline evaluation. As the result, it is found that the self align type crystal structure having projection parts is obtained.

The above-mentioned result shows that a nitride thin film without composition deviation is formed by controlling the ambient gas pressure even in the case that an inert gas containing no nitrogen is used in the nitride thin film forming by means of the thin film forming process of the present embodiment. In other words, as described with reference to FIG. 6 for the embodiment 1, it is likely that the crystalline orientation nitride thin film that maintains the stoichiometric composition by optimizing the interaction (collision, scattering, and enclosing effect) between the material emitted from the target when a laser is irradiated thereon (mainly atoms, ions, and clusters) and the inert gas.

Furthermore, as described in the embodiment 1, the correlation between the ambient gas pressure (P) and the distance between the target and substrate (D) should be maintained for laser ablation. The material emitted from the target by laser irradiation forms the plasma state that is so-called as plume. The size of a plume depends on the gas pressure because the plume is influenced by collision with the ambient gas, and the larger gas pressure gives the smaller plume.

On the other hand, to obtain the oriented thin film of the stoichiometric composition, it is desirable that the above-mentioned nitriding promotion area formed in the plume is in contact with the substrate. In detail, D=3 cm in the present embodiment. In this case, the oriented thin film is obtained under the condition of P=1.0 Torr. In the case that D is to be larger, the plume is made larger. In other words, the gas pressure may be lowered. Furthermore, the film quality of a deposit thin film depends significantly on the speed of the material emitted from the target at the time when the material reaches to the deposition substrate. Therefore, to obtain the same film quality, the correlation $PD^n$=constant should be maintained as the process condition to obtain a constant speed, and n value is preferably in the range from 2 to 3. Therefore, for example, in the case that D is double, the corresponding gas pressure may be ¼ to ⅛.

As described hereinabove in the cold cathode forming process of the present embodiment, to prevent composition deviation from the stoichiometric composition due to the removal of the high vapor pressure element in the case that the laser ablation is carried out by use of a target material consisting of the material containing the high vapor pressure element (herein, nitrogen), the ambient gas pressure and the distance between the target and the deposition substrate are controlled so that the crystalline thin film of the stoichiometric composition is formed by forming a plume having a suitable size, instead of the process in which the high vapor pressure element is supplemented to the ambient gas by use of a gas that contains the high vapor pressure element. In other words, the loss of the high vapor pressure element is prevented in the plume having a suitable size, and a thin film of approximately the same composition as that of the target is formed on the deposition substrate. The plume having a suitable size means the size of the plume that allows the facilitated oxidation region formed in the plume to be in contact with the surface of the deposition substrate. Therefore, in the cold cathode forming process in accordance with the present embodiment, the ambient gas pressure that is sufficient to form a plume having such suitable size and the distance between the target and the deposition substrate are set properly.

In the use of this process, the pressure of the ambient gas is controlled, that is, the collision frequency between material ejected from the target and the ambient gas atoms is controlled to control the proportion of the high vapor pressure element enclosed in the high temperature high pressure area formed in the plume. Thereby, it is made possible to control the configuration of the crystal and defect of the thin film to be formed.

Furthermore, in some cases, a thin film is involved in the problem of poor crystallinity and defect immediately after forming. When such problem is found, nitriding of the thin film in a nitrogen atmosphere or heat treatment in an inert gas atmosphere is effective to improve the film quality such as crystallinity and purity.

As described hereinbefore, the crystal orientation nitride thin film having the stoichiometric composition can be formed by applying the cold cathode forming process of the present embodiment without introduction of reactive gas or substrate heating. Therefore, by using this process, the fabrication process is simplified and low cost process is realized without limitation of substrate material used to form the cold cathode.

Furthermore, in the case of the cold cathode formed by means of the above-mentioned process, a voltage of approximately 10 V/μm is applied between the Mo metal layer 63 and crystalline thin film 65 at a degree of vacuum of $10^{-6}$ Torr and a target to be irradiated is placed at the position 3 mm apart vertically, the stable electron emission of approximately 2 mA/cm$^2$ is confirmed. Based on the result, it is found that the formed cold cathode forms a plurality of self-aligned projections and a voltage is applied effectively to the projections, a high electric field intensity is applied on the respective projections to result in the reduced electron emission threshold value, and the increased and stabilized emission current value is realized as a whole.

The cold cathode forming process by use of TiN thin film, which is binary based nitride transparent conductive thin film, is described hereinabove, however, it is possible to use other transparent conducting material such as BN, SrN, ZrN, and HfN as the cold cathode material.

The process in accordance with the present embodiment can be applied not only to nitride compound but also to material having a low electron emission threshold value (small electron affinity) that is suitably used as the cold cathode material. Particularly, this process can be applied to form a thin film consisting of multicomponent base material by processing materials that are different in the melting point and vapor pressure simultaneously (evaporation and deposit). Forming of such thin film has been difficult by means of the conventional thermal equilibrium process technique. Examples of such materials include compounds such as $LaB_6$, TiC, SiC and SnC and transparent conductor materials such as $In_2O_3$, $SnO_2$, ITO, ZnO, $TiO_2$, $WO_3$, and $CuAlO_2$. Furthermore, in the case that metal material (W, Mo), which is oxidized easily and difficult to form projection configuration by means of the conventional process, is used as the electron emission material, it is possible to form high purity projection configuration with self-alignment by use of a high purity target.

As described hereinbefore, because electrons are emitted from micro-structure parts directed in the same direction in the case of the electron emission element of the present embodiment, the present invention provides a multi source cold cathode that emits electrons in the same direction. Therefore, in the case that the cold cathode is applied to a CRT electron source, the structure of an electron gun that is used for accelerating and converging electrons is simplified differently from the case in which a conventional electron source is used, and a thin CRT can be realized. Furthermore, the current density of the electron source is increased and stabilized, the electron source of this type can be used as a high vision electron source for which high brightness and high definition are required.

(Third Embodiment)

A flat display having an electron emission element of the present invention as the electron source will be described hereinafter with reference to FIG. 8.

Figure 8:
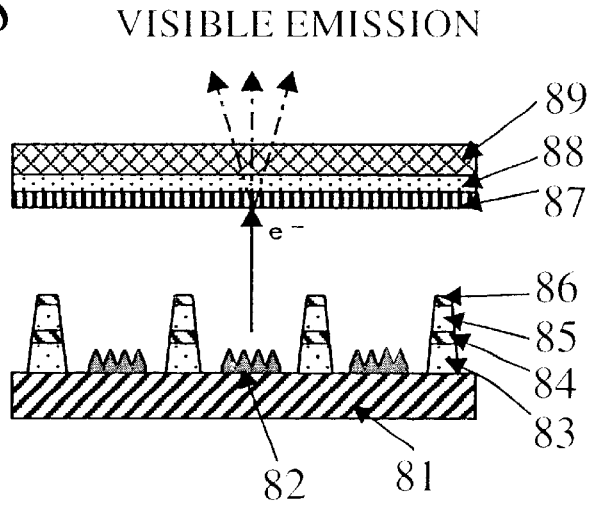
FIG. 8 is a cross sectional view showing the structure of a flat display in accordance with an embodiment 3 of the present invention.

FIG. 8 is a cross sectional view showing the structure of the flat display of the present invention. In FIG. 8, 81 denotes an Si substrate and 82 denotes a cold cathode formed on the substrate 81, which is formed of crystalline thin film consisting of electron emissive material shown in FIG. 2 as described in the embodiment 1. A numeral 83 denotes a first insulating film, 84 denotes a first gate, 85 denotes a second insulating film, and 89 is a second gate.

The first gate 84 and the second gate 86 are formed in the matrix fashion so as to be an orthogonal line, the end is connected to the external circuit through frit seal, and the intersection of these lines constitutes a pixel. A numeral 87 denotes a fluorescent substance layer, 88 denotes a transparent conductive film anode, and 89 denotes a transparent faceplate. A gas of, for example, 200 $\mu$m is secured between the faceplate 89 and the Si substrate 81 by means of a bulkhead not shown in the drawing, the end is bonded with a frit glass, and the internal is maintained in high vacuum condition.

The operation of the above-mentioned structure will be described. For example, a voltage of approximately 400 V is applied on the transparent conductive film 88 with respect to the Si substrate 81 to function as an anode. When a voltage of, for example, approximately 60 V is applied on both first gate 84 and second gate 86, electrons are emitted as shown in FIG. 8 because the cold cathode 82 comprises a crystalline thin film consisting of electron emissive material. Emitted electrons proceed in the vacuum internal towards the transparent conductive film 88 by means of the electric filed formed by the voltage of the transparent conductive film 88, excite the fluorescent material layer 87 disposed facing to the transparent conductive film 88 to generate visible emission. The emission is to be ejected to the outside through the faceplate 89.

On the other hand, when the voltage of any one of the first gate 84 and the second gate 86 is 60V and the voltage of the other gate is 0 V, no electron is ejected due to tradeoff between the electric fields.

Figure 6:
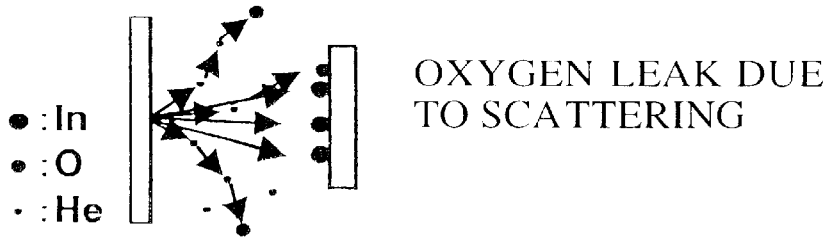
FIG. 6 is a diagram for describing the mechanism of crystal structure control.
Figure 6:
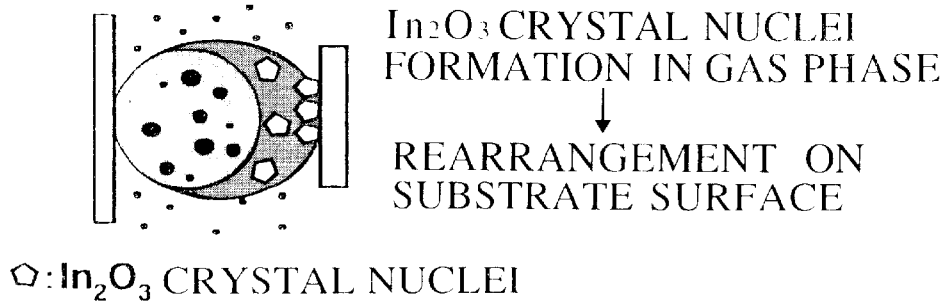
Figure 6:
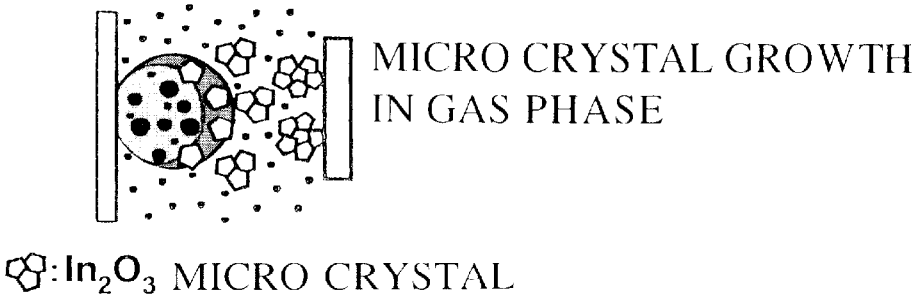

The cold cathode 82 used in the present embodiment has the same structure as the cold cathode structure described in the embodiment 1, but the cold cathode structure described in the embodiment 2 may be employed. In detail, the cold cathode 82 comprises an interference layer formed of a conductive film or resistive film formed on the aperture of the substrate 81 as shown in FIG. 6 and a crystalline thin film formed thereon. Herein, by controlling the film thickness of both thin films so that the electron emission end of the crystalline thin film is located at the same plane position as that of the gate, it is possible to increase the electric field intensity, that is, it is possible to lower the electron emission starting voltage. The interference layer comprising a resistive film enables the current to be stabilized the more. Furthermore, the interference layer that is a base layer for forming the crystalline thin film consisting of conductive film or resistive film having the same orientation as that of the crystalline thin film is effective for crystallization of the thin film that is formed thereon, and the tip end configuration of the electron emission part is stabilized.

As described hereinabove, in the flat display of the present embodiment, because electrons are emitted from fine structure of the electron source directed in the same direction, a multi source cold cathode that emits electrons in the same direction can be obtained. The above-mentioned structure is effective to lower the electron emission threshold value of an electron source and realize the increased emission current value and stabilization, and furthermore realize the low voltage flat display at a low cost.

(Fourth Embodiment)

A transmission type flat display provided with an electron emission element of the present invention as the electron source will be described in detail hereinafter with reference to FIG. 9.

Figure 9:
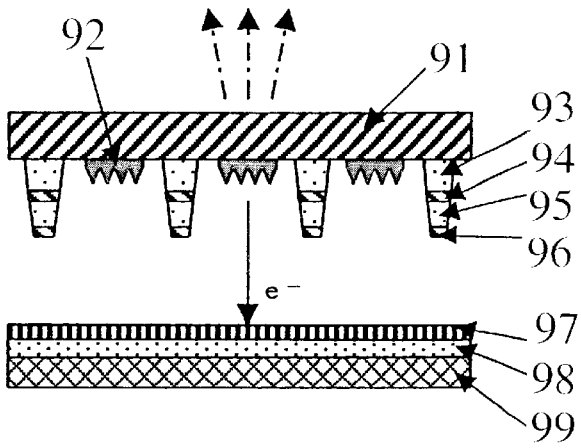
FIG. 9 is a cross sectional view showing the structure of a transmission type flat display in accordance with the embodiment 4 of the present invention.

FIG. 9 is a cross sectional view showing the structure of a transmission type flat display of the present invention. In FIG. 9, 91 denotes a transparent substrate, and 92 denotes a cathode formed on the transparent substrate 91, which comprises the crystalline thin film consisting of the transparent conducting material shown in FIG. 2. A numeral 93 denotes a first gate, 95 denotes a second insulating film, and 96 denotes a second gate. The first gate 94 and the second gate 96 are formed in the matrix fashion so as to be an orthogonal line, the end is connected to the external circuit through frit seal, and the intersection of these lines constitutes a pixel. A numeral 97 denotes a fluorescent substance layer, 98 denotes an anode electrode layer, and 99 denotes a transparent faceplate. A gas of, for example, 200 $\mu$m is secured between the faceplate 99 and the transparent substrate 91 by means of a bulkhead not shown in the drawing, the end is bonded with a frit glass, and the internal is maintained in high vacuum condition.

The operation of the above-mentioned structure will be described. For example, a voltage of approximately 400 V is applied on the anode electrode layer 98 with respect to the transparent substrate 91 to function as an anode. When a voltage of, for example, approximately 60 V is applied on both first gate 94 and second gate 96, electrons are emitted as shown in FIG. 9 because the cold cathode 92 comprises a crystalline thin film consisting of electron emissive material. Emitted electrons proceed in the vacuum internal towards the anode electrode layer 98 by means of the electric filed formed by the voltage of the anode electrode layer 98, excite the fluorescent material layer 97 disposed facing to the anode electrode layer 98 to generate visible emission. The emission is to be viewed from the outside through the transparent cold cathode 92 and the transparent substrate 91.

On the other hand, when the voltage of any one of the first gate 94 and the second gate 96 is 60V and the voltage of the other gate is 0 V, no electron is ejected due to tradeoff between the electric fields.

The cold cathode 92 used in the present embodiment has the same structure as the cold cathode structure described in the embodiment 1, but the cold cathode structure described in the embodiment 2 may be employed. In detail, the cold cathode 92 comprises an interference layer formed of a conductive film or resistive film formed on the aperture of the substrate 91 as shown in FIG. 6 and a crystalline thin film formed thereon. Herein, by controlling the film thickness of both thin films so that the electron emission end of the crystalline thin film is located at the same plane position as that of the gate, it is possible to increase the electric field intensity, that is, it is possible to lower the electron emission starting voltage. The interference layer comprising a resistive film enables the current to be stabilized the more. Furthermore, the interference layer that is a base layer for forming the crystalline thin film consisting of conductive film or resistive film having the same orientation as that of the crystalline thin film is effective for crystallization of the thin film that is formed thereon, and the tip end configuration of the electron emission part is stabilized.

By using a cold cathode comprising a transparent conductive crystalline thin film in a flat display as in the present invention, a transmission type flat display is realized as described hereinabove. Furthermore, because electrons are emitted from the fine structure part of an electron source directed in the same direction, a multi source cold cathode that emits electron in the same direction is realized. The above-mentioned structure is effective to lower the electron emission threshold value of an electron source and realize the increased emission current value and stabilization, and furthermore realize the low voltage flat display at a low cost.

What is claimed is:

1. A cold cathode forming process comprising a step for providing a target material and a substrate in a reaction chamber, a step for controlling the pressure (P) of an ambient gas introduced into the reaction chamber and the distance (D) between the substrate and the target material so that the size of a high temperature high pressure area formed near the target material by irradiating a beam light onto the target material is optimal, and a step for exciting and ejecting the material contained in the target material by irradiating the beam light onto the target material with introducing the ambient gas into the reaction chamber at the pressure to deposit the material on the substrate.

2. The cold cathode forming process as claimed in claim 1, wherein the pressure (P) of the ambient gas and the distance (D) between the substrate and the target material are controlled according to the relation $PD^n$=constant (n is approximately 2 to 3).

3. The cold cathode forming process as claimed in claim 1, wherein the ambient gas is an inert gas.

4. The cold cathode forming process as claimed in claim 1, wherein the pressure of the ambient gas is in the range from 0.1 to 10 Torr.

5. The cold cathode forming process as claimed in claim 1, wherein the material that constitutes the target contains at least two compositions.

6. The cold cathode forming process as claimed in claim 1, wherein the material that constitutes the target material is any one compound of $LaB_6$, TiC, SiC, and SnC.

7. The cold cathode forming process as claimed in claim 5, wherein the material that constitutes the target material is any typical nitride of TiN, BN, SrN, ZrN, and HfN.

8. The cold cathode forming process as claimed in claim 5, wherein the material that constitutes the target material is any one transparent conducting material of $In_2O_3$, $SnO_2$, ITO, ZnO, $TiO_2$, $WO_3$, and $CuAlO_2$.

* * * * *